US011751699B2

(12) United States Patent
Festa

(10) Patent No.: US 11,751,699 B2
(45) Date of Patent: Sep. 12, 2023

(54) BOOSTER SEAT FOR CHILDREN

(71) Applicant: Artsana S.p.A., Grandate CO (IT)

(72) Inventor: Antonella Festa, Como CO (IT)

(73) Assignee: Artsana S.p.A., Grandate CO (IT)

( * ) Notice: Subject to any disclaimer, the term of this patent is extended or adjusted under 35 U.S.C. 154(b) by 0 days.

(21) Appl. No.: 17/626,533

(22) PCT Filed: Jul. 6, 2020

(86) PCT No.: PCT/IB2020/056342
§ 371 (c)(1),
(2) Date: Jan. 12, 2022

(87) PCT Pub. No.: WO2021/009609
PCT Pub. Date: Jan. 21, 2021

(65) Prior Publication Data

US 2022/0400872 A1 Dec. 22, 2022

(30) Foreign Application Priority Data

Jul. 16, 2019 (IT) ..... 102019000011859

(51) Int. Cl.
*A47D 1/00* (2006.01)

(52) U.S. Cl.
CPC ..... *A47D 1/0083* (2017.05); *A47D 1/0085* (2017.05)

(58) Field of Classification Search
CPC ..... A47D 1/023; A47D 1/002; A47D 1/0085; A47D 1/02
(Continued)

(56) References Cited

U.S. PATENT DOCUMENTS

D306,803 S * 3/1990 Kassai ..... D6/339
2020/0128970 A1* 4/2020 Pujol ..... A47D 1/023

FOREIGN PATENT DOCUMENTS

CN 201536856 U * 8/2010 ..... A47D 1/004
CN 106343821 1/2017
(Continued)

OTHER PUBLICATIONS

International Search Report and Written Opinion dated Aug. 20, 2020; Application PCT/IB2020/056342; 10 pages.

*Primary Examiner* — Sarah B McPartlin
(74) *Attorney, Agent, or Firm* — Mark E. Bandy; Rankin Hill & Clark, LLP

(57) ABSTRACT

A booster seat (1) for children comprising a frame (2) composed of a front structure (3) and a rear structure (4), the front structure (3) comprising a lower base portion (5) and an upper backrest portion (6), the rear structure (4) being rotatably attached to the lower base portion (5); a seat portion (8) rotatably attached to the upper backrest portion (6); a tray (9) comprising a pair of lateral arms (11); the tray (9) being rotatably attached to the upper backrest portion (6) for the tray (9) to be commuted between a use configuration in which the tray (9) overhangs the upper backrest portion (6) and a stored configuration in which the tray (9) is substantially parallel to the upper backrest portion (6); the booster seat (1) being adapted to be commuted between an open configuration and a closed configuration whereby, in the open configuration, the lower ends of the lower base portion (5) and the lower ends of the rear structure (4) are spaced apart from each other, with the seat portion (8) substantially parallel to the tray (9) which is in the use configuration, and in the closed configuration, the lower ends of the lower base portion (5) are close to the lower ends
(Continued)

of the rear structure (4) with the seat portion (8) and the tray (9) substantially parallel to the upper backrest portion (6).

10 Claims, 7 Drawing Sheets

(58) Field of Classification Search
USPC ..... 297/55, 148
See application file for complete search history.

(56) References Cited

FOREIGN PATENT DOCUMENTS

| | | | | |
|---|---|---|---|---|
| EP | 3042588 | | 7/2016 | |
| FR | 947210 | | 6/1949 | |
| TW | M577278 | U | 5/2019 | |
| WO | WO-2008028598 | A1 * | 3/2008 | ..... A47D 1/002 |

* cited by examiner

BOOSTER SEAT FOR CHILDREN

FIELD OF THE INVENTION

The present invention relates to a booster seat for children with a folding tray.

DESCRIPTION OF THE PRIOR ART

Booster seats for children allow children to sit on normal chairs at a table, in case a child is too small to use a normal adult chair but has grown enough to find the high chair too narrow and uncomfortable, or when the use of the high chair is not practical. Furthermore, many booster seats have a tray as a replacement for the table top.

Booster seats are folded to a more compact closed form for storage when not in use and for easier transport. To do this, the backrest of the booster seat is first folded down onto the seat portion, and the legs, which are crossed and rotatably hinged at their center under the seat portion, collapse in a scissors-like fashion.

In the prior art, the tray being a single piece and being engaged in cantilever fashion to the rest of the booster seat, the booster seat can be only folded to the closed position after removing the tray. Following removal of the tray, the booster seat is folded to a closed position and the tray is attached to the closed booster seat to form a single compact assembly that is easy to carry and/or store.

Problem of the Prior Art

In the prior art, in order to fold, store and carry the booster seat, the tray must be first separated from the frame, the latter must be moved to a closed position by folding down the backrest onto the seat portion and collapsing the legs, and then the tray must be engaged once again to the closed frame. Then, in order to use the booster seat again, the tray must be disengaged to open the frame and later re-engaged thereto. Therefore, when the booster seat is open and has to be folded to the closed position, the backrest cannot be folded down onto the seat portion if the tray is not removed. Likewise, when a previously closed booster seat is reopened, the tray must be removed from the booster seat when the latter is still closed.

SUMMARY OF INVENTION

The object of the present invention is to provide a booster seat for children that can be more easily and smoothly moved to a closed configuration, while obviating the aforementioned prior art problems, In particular, the object of the invention to provide a booster seat which can be folded to a closed form with a simple and smooth mechanism.

These and other objects are fulfilled by a booster seat for children as defined in any of the accompanying claims.

BRIEF DESCRIPTION OF THE DRAWINGS

The characteristics and advantages of the present invention will result from the following detailed description of a possible practical embodiment, illustrated as a non-limiting example in the set of drawings, in which.

Figure 1:
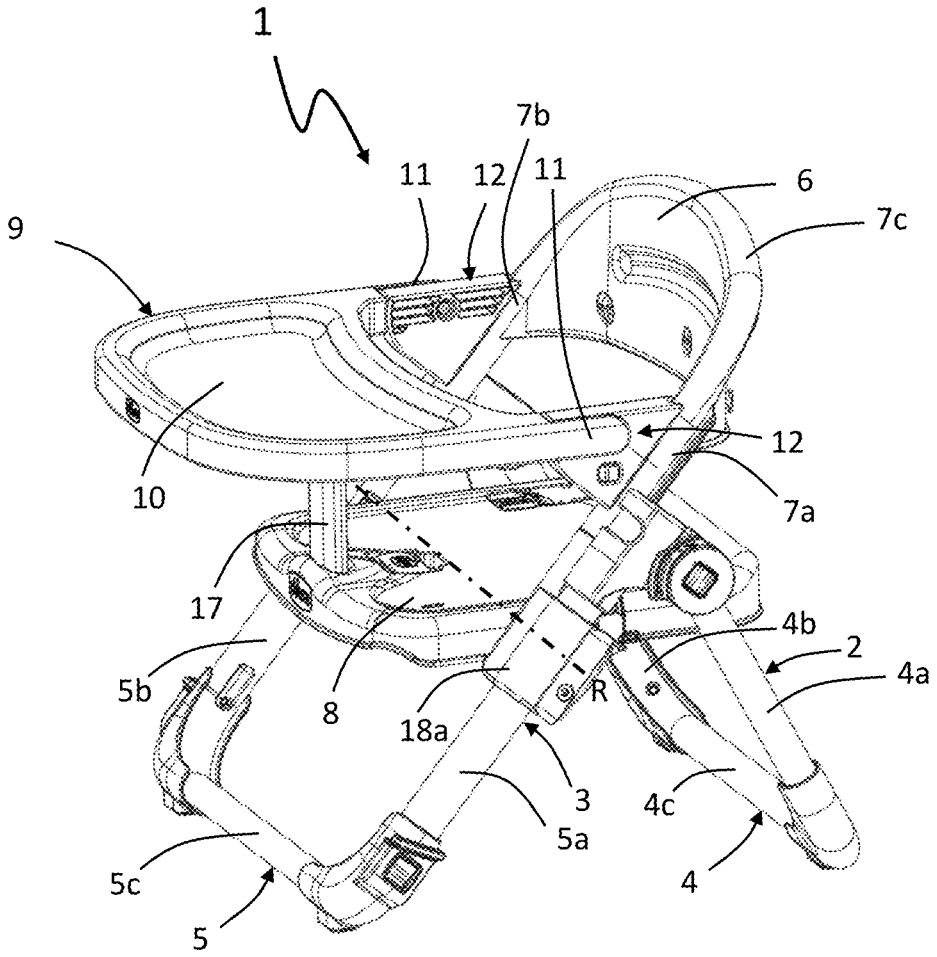
FIG. 1 shows a perspective view of a booster seat of the present invention.
Figure 2:
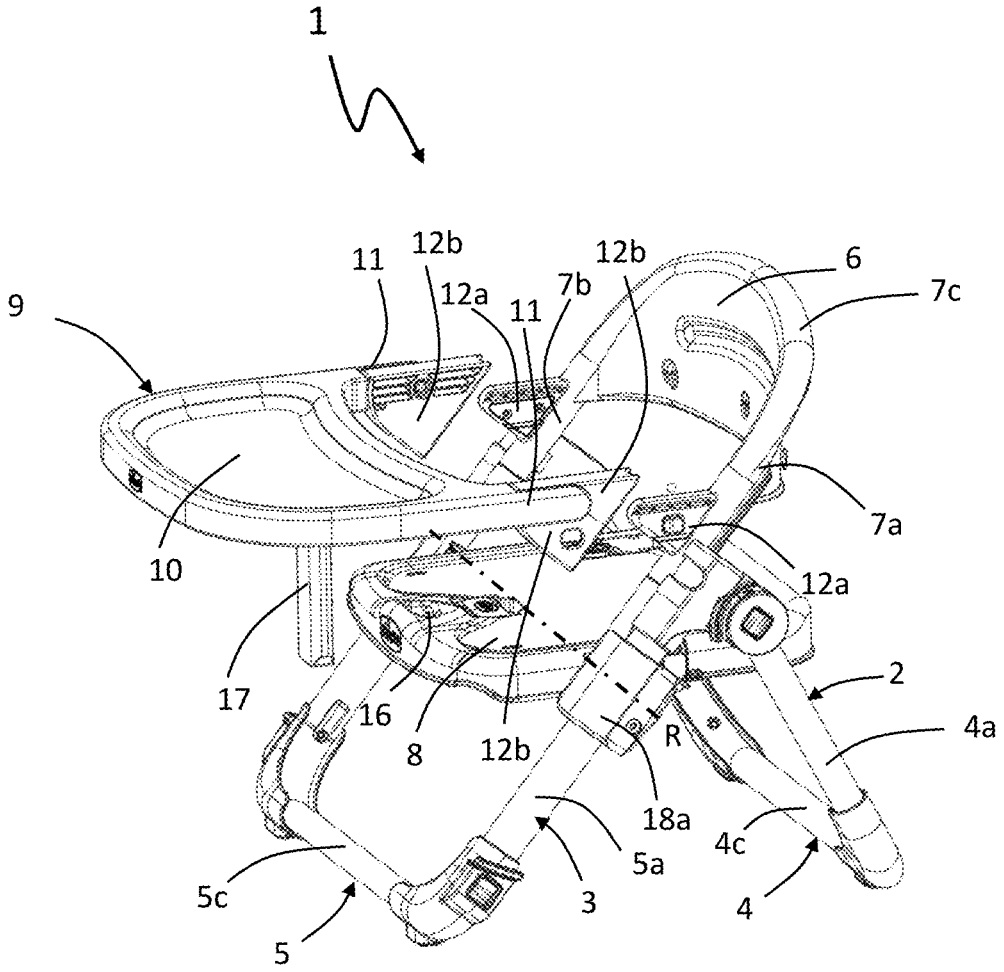
FIG. 2 shows a perspective view of the booster seat of FIG. 3 with the tray disengaged.

The booster seat as shown in the accompanying figures shall be deemed to be schematically illustrated, not necessarily drawn to scale, and not necessarily representing the actual proportions of its parts.

DETAILED DESCRIPTION

The figures show a booster seat according to the invention, generally designated by numeral 1.

The booster seat 1 comprises a frame 2 composed of a front structure 3 and a rear structure 4. The front structure 3 is formed by a lower base portion 5 and an upper backrest portion 6.

Both the lower base portion 5 and the rear structure 4 may be either composed, for example, of a single support, as shown in the accompanying figures, or have two distinct lateral support feet, not shown in the accompanying figures, to form, in the former case, a front and a rear support with two large bearing surfaces or, in the latter case, two front supports and two rear supports with four separate bearing areas. The upper backrest portion 6 comprises two upper lateral uprights 7*a*, 7*b*. Also, the rear structure 4 is rotatably connected to the lower base portion 5.

The booster seat 1 comprises a seat portion 8 that is attached to the upper backrest portion 6 to rotate about an axis of rotation R and a tray 9. The seat portion 8 is rotatably attached to the upper backrest portion 6 below the region in which the lower support portion 5 is rotatably attached to the rear structure 4. The tray 9 comprises a base plate 10 and a pair of lateral arms 11, which are connected to the base plate 10.

Furthermore, the booster seat 1 comprises engagement/disengagement means 12, preferably for quick engagement/disengagement, for reversibly attaching the tray 9 to the upper backrest portion 6 of the booster seat 1. The engagement/disengagement means 12 are located above the region in which the seat portion 8 is rotatably attached to the lower base portion 5. The engagement/disengagement means 12 are composed of a pair of first components 12*a* respectively fixed to the upper lateral uprights 7*a*, 7*b* and a pair of second components 12*b* which can be reversibly engaged with the pair of first components 12*a* respectively. The pair of second components 12*b* can be disengaged from the pair of first components 12*a* to allow the tray 9 to be removed from the booster seat 1.

The pair of second components 12*b* of the booster seat 1 is rotatably attached to the pair of lateral arms 11 of the tray 9 to commute the tray 9 between a use configuration and a stored configuration. In the use configuration, the tray 9 projects in cantilever fashion from the upper backrest portion 6 and, for example, objects may be laid on the base plate 10 and the tray 9 may be used as a table On the other hand, in the stored configuration, the tray 9 is substantially parallel to the upper backrest portion 6. Preferably, the extension plane of the tray 9 is parallel to the extension plane of the upper backrest portion 6.

The booster seat 1 is adapted to be commuted between an open configuration and a closed configuration. In the open configuration, the lower ends of the lower base portion 5 and the lower ends of the rear structure 4 are spaced apart with the seat portion 8 substantially parallel to the tray 9 in the use configuration. The seat portion 8 is preferably is parallel to the tray 9. In the closed configuration, the lower ends of the lower base portion 5 are close to the lower ends of the rear structure 4 with the seat portion 8 and the tray 9 substantially parallel to the upper backrest portion 6. Preferably, in the closed configuration, the extension plane of the tray 9 and the extension plane of the seat portion 8 are parallel to the extension plane of the lower base portion 5.

Figure 8:
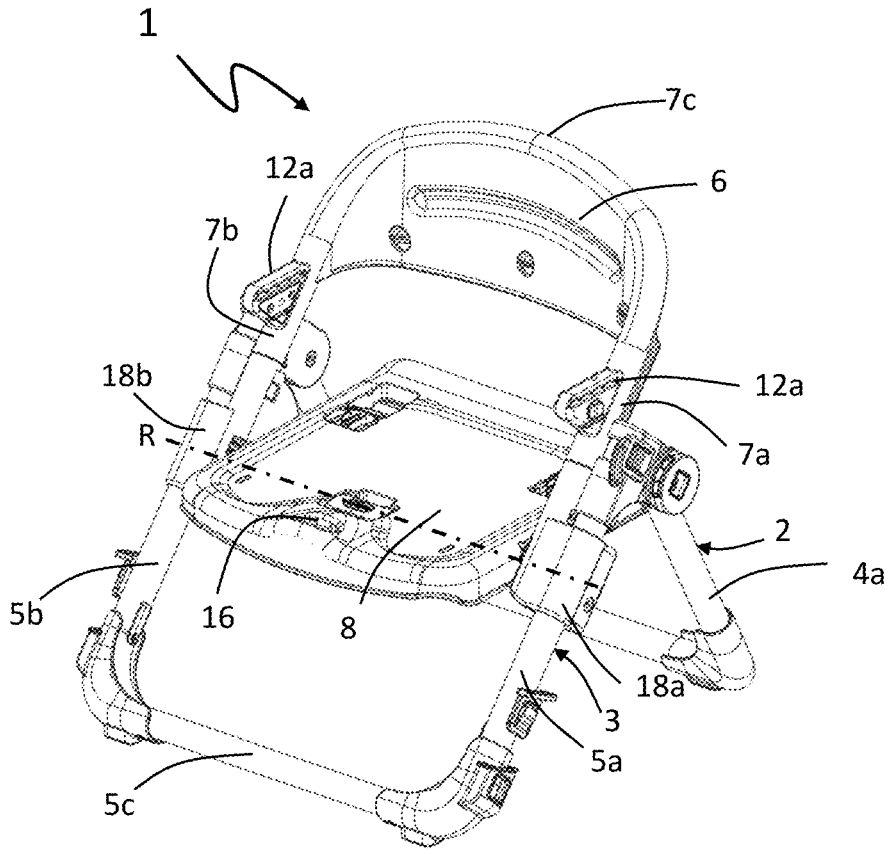
FIG. 8 shows a perspective view of a booster seat of FIG. 1 without the tray.

The open configuration is the configuration adapted for use of the booster seat 1, with the booster seat 1 being placed, for example, on a chair and the child sitting on the seat portion 8. In addition, as shown in FIG. 8, the tray 9 may be removed from the booster seat 1 with the child using a table as a supporting surface instead of the base plate 10 of the tray 9. Conversely, the closed configuration is the configuration adapted for storage of the booster seat 1 when not in use for easy transportation thereof.

Figure 5:
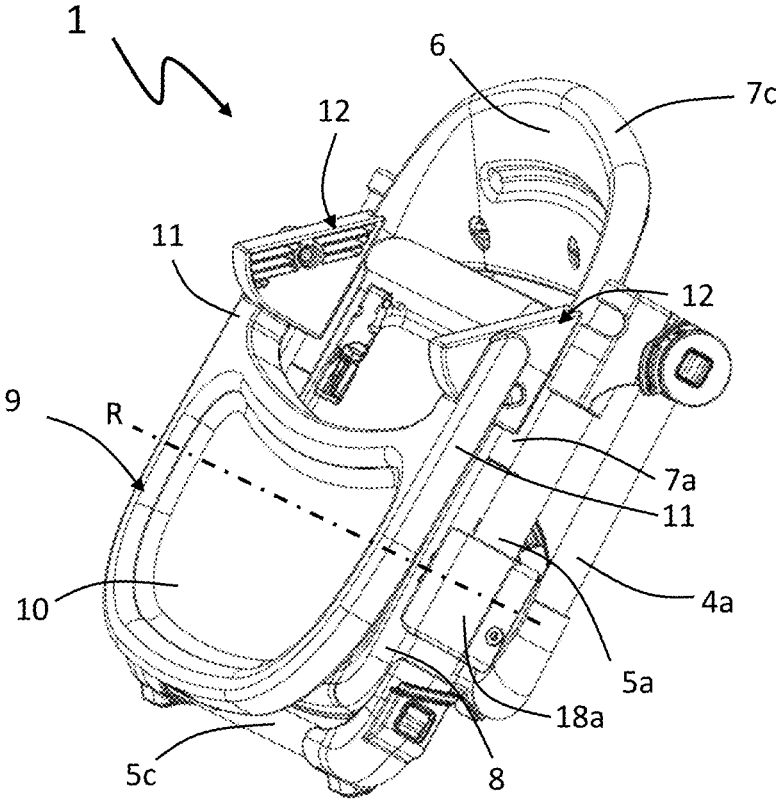
FIG. 5 shows a perspective view of the booster seat of FIG. 3 in the closed configuration.
Figure 6:
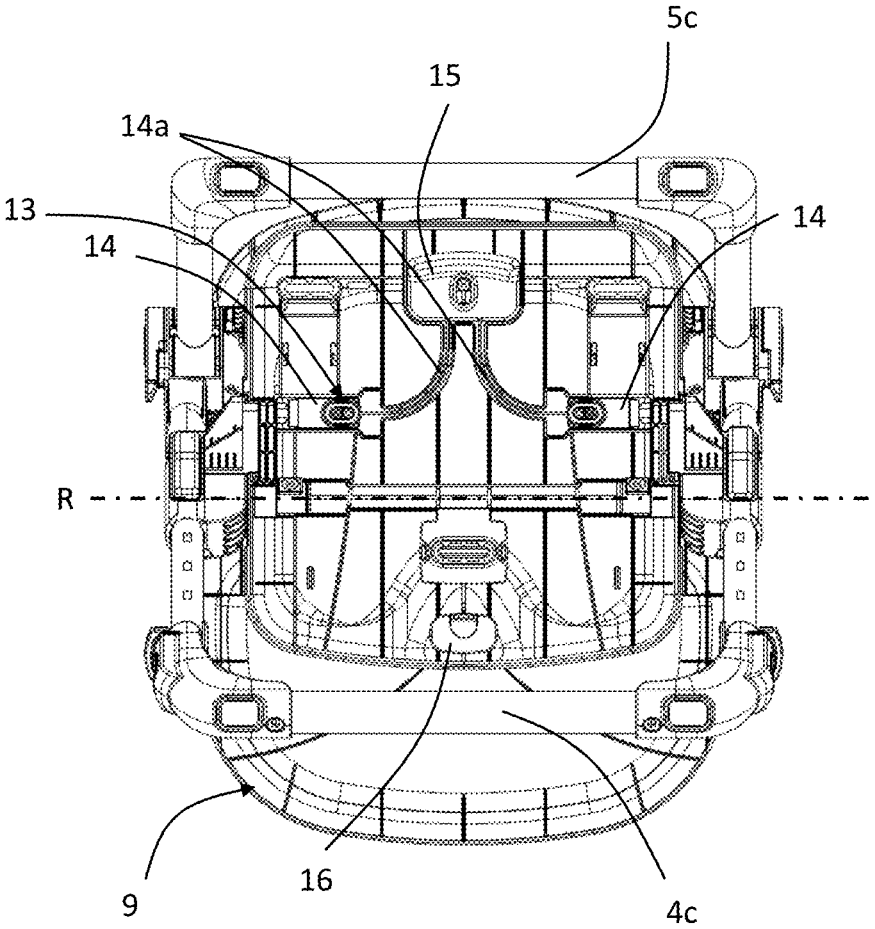
FIG. 6 shows a bottom view of the booster seat of FIG. 1.

In a preferred embodiment, the booster seat 1 comprises two sleeves 18*a*, 18*b* fixed to the sides of the upper backrest portion 6 and telescopically connected to the lower base portion 5. The seat portion 8 is rotatably attached to the sleeves 18*a*, 18*b*. In other words, the sleeves 18*a*, 18*b* are fixed in a manner that they will be rigidly joined to the upper backrest portion 6, i.e. with no relative movement between the sleeves 18*a*, 18*b* and the upper backrest portion 6. Preferably, each sleeve 18*a*, 18*b* comprises a first coupling for the upper backrest portion 6 and a second coupling for the lower base portion 5. Each sleeve 18*a*, 18*b* is fixed with respect to the upper backrest portion 6 and can slide relative to the lower base portion 5. This configuration is used to slide the upper backrest portion 6 and the seat portion 8 in a rigidly joined state so that the upper backrest portion 5 and the seat portion 8 may be lifted or lowered with respect to the lower base portion 5 to adjust the upper backrest portion 6 and the seat portion 8 according to the height of the child (open configuration) or may be fully lowered for storage of the booster seat 1 as shown in FIG. 5 (closed configuration). The lower base portion 5 is caused to slide in the two sleeves 18*a*, 18*b* to move toward the upper backrest portion 6 and the seat portion 8, for the structure of the booster chair 1 to be compacted and conveniently stored in the closed configuration.

In a preferred embodiment, the lower base portion 5 comprises two lower lateral uprights 5*a*, 5*b*. The upper lateral uprights 7*a*, 7*b* are telescopically connected to the lower lateral uprights 5*a*, 5*b* via the sleeves 18*a*, 18*b*. In particular, each upper lateral upright 7*a*, 7*b* is telescopically connected to a respective lower lateral upright 5*a*, 5*b* by means of a respective sleeve 18*a*, 18*b*. The two sleeves 18*a*, 18*b* are respectively fixed to the sides of the two upper lateral uprights 7*a*, 7*b*. Advantageously, the upper lateral uprights 7*a*, 7*b* and the lower lateral uprights 5*a*, 5*b* are laterally aligned with respect to the seat portion 8 for the structure to have greater stability than in prior art booster seats.

In addition, the rear structure 4 is rotatably attached to the lower base portion 5. Preferably, the rear structure 4 comprises two rear lateral uprights 4*a*, 4*b* rotatably attached to the front structure 3. More preferably, each rear upright 4*a*, 4*b* is rotatably attached to a respective upper lateral upright 7*a*, 7*b*.

In a preferred embodiment as shown in the accompanying figures, the two upper lateral uprights 7*a*, 7*b* and the two lower uprights 5*a*, 5*b* lie on the same plane. Furthermore, the front structure 3 comprises a lower rod 5*c* and an upper rod 7*c*, each perpendicular to the upper uprights 7*a*, 7*b* and the lower uprights 5*a*, 5*b*, respectively. Specifically, the upper rod 7*c* and the two upper lateral uprights 7*a*, 7*b* form a U-shaped structure and, likewise, the lower rod 5*c* and the lower uprights 5*a*, 5*b* form a U-shaped structure These U-shaped structures of the upper backrest portion 6 and the lower base portion 5 respectively lie on the same plane as the upper lateral uprights 7*a*, 7*b* and the lower lateral uprights 5*a*, 5*b*. Likewise, the rear structure 4 comprises a rear rod 4*c* which forms a U-shaped structure with the two rear uprights 4*a*, 4*b*. The U-shaped rear structure 4 lies on a plane inclined at a predetermined angle with respect to that of the lower base portion 5 and of the upper backrest portion 6 in the open configuration, and lied on a plane parallel to that of the lower base portion 5 and of the upper backrest portion 6 in the closed configuration.

In another preferred embodiment, the booster seat 1 comprises locking/unlocking means 13 which are operable on the seat portion 8 for reversible commutation between a locked configuration and an unlocked configuration. The locking/unlocking means 13 are located on a bottom surface of the seat portion 8 and fit into appropriate seats formed on the upper backrest portion 6 and namely in the sleeves 18*a*, 18*b*. In the locked configuration, the seat 8 is rotatably constrained with respect to the structure 3. Conversely, in the unlocked configuration, the seat 8 is rotatably released with respect to the structure 3.

According to a preferred embodiment, the booster seat 1 may be commuted between the open configuration and the closed configuration by commuting the locking/unlocking means 13 from the locking configuration to the unlocking configuration. In the open configuration, the locking/unlocking means 13 are in the locked configuration in which they keep the seat portion 8 substantially parallel to the tray 9 in the use configuration.

Figure 3:
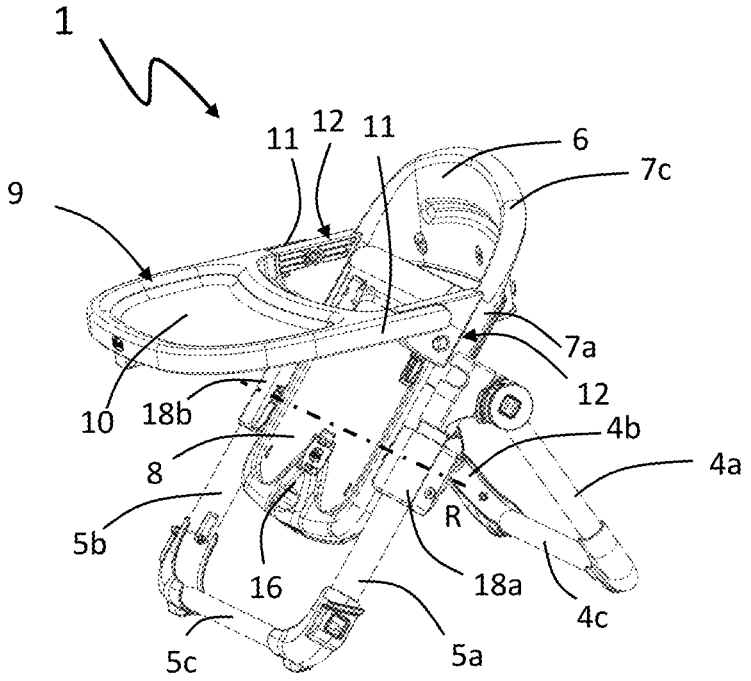
FIG. 3 shows a perspective view of the booster seat of FIG. 1 with the seat portion parallel to the upper backrest portion.
Figure 4:
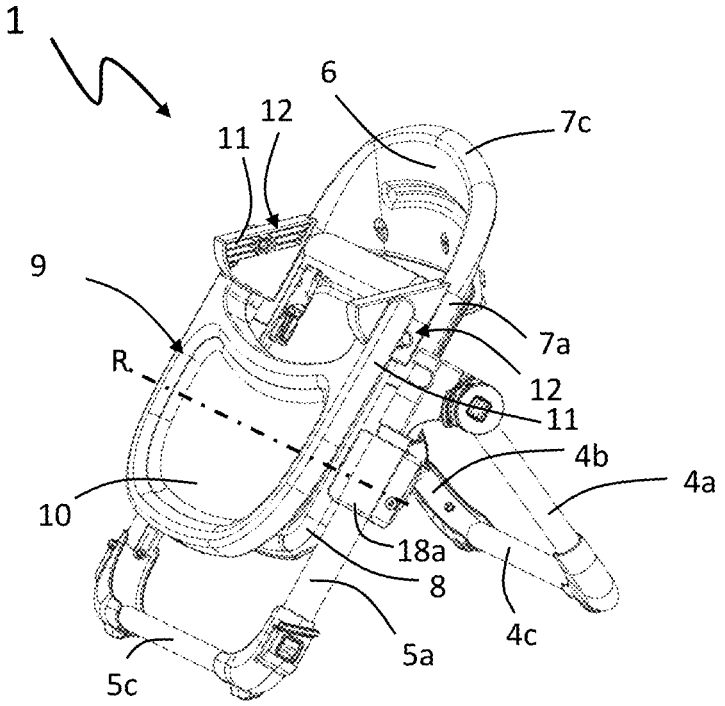
FIG. 4 shows a perspective view of the booster seat of FIG. 1, with both the seat portion and the tray parallel to the upper backrest portion.

As shown in FIGS. 3 and 4, during commutation between the open configuration and the closed configuration, the seat portion 8 and the tray 9 move from the open configuration to the closed configuration.

Preferably, during commutation between the open configuration and the closed configuration, the respective extension planes of the rear structure 4, the tray 9, the seat portion 8 and of the lower base portion 5 are parallel to one another.

Preferably, the locking/unlocking means 13 comprise a pair of retaining elements 14 and a lever 15 operable on the pair of retaining elements 14. The pair of retaining elements 14 and the lever 15 are connected to each other by means of flexible connecting elements 14*a*. The retaining elements 14 engage the frame 2 at two respective points behind the axis of rotation R of the seat portion 8 to lock the rotation of the seat 8 with respect to the upper backrest portion 6 and in particular with respect to the sleeves 18*a*, 18*b* in the locked configuration. The lever 15 is adapted to be operated manually by a force applied by the user to disengage the retaining elements 14 from the frame 2 and in particular from the sleeves 18*a*, 18*b* of the upper backrest portion 6, in the unlocked configuration for the seat portion 8 to be commuted from the use configuration to the stored configuration.

In a further preferred embodiment, the locked configuration is required as a safety, to ensure that the seat portion 8 will not rotate about the axis of rotation R under a force inadvertently applied to the seat portion 8, such as the force applied when a child leans forward and his/her weight is excessively displaced toward the front part of the seat portion 8. On the other hand, the unlocked configuration is required when the booster seat 1 is to be moved to the closed configuration.

In a preferred embodiment, the seat portion 8 comprises a hole 16 in a substantially central position of the seat portion 8, the hole 16 being preferably centered with respect to the sides of the seat portion 8 and being closer to the front side thereof than to the rear side. The tray 9 comprises a base plate 10 and a rod 17 for supporting the base plate 10. The rod 17 is rotatably attached to the base plate 10 and is configured to move between a supporting position and a rest position. In the supporting position, the rod 17 is perpendicular to the base plate 10 and fits into the hole 16 to keep the tray 9 in the use configuration, by acting as an upright. Preferably, in the supporting position the rod 17 is perpendicular to the extension plane of the base plate 10. Conversely, in the rest position, the rod 17 is disengaged from the hole 16 and substantially parallel to the base plate 10. Preferably, in the rest position, the rod 17 is parallel to the extension plane of the base plate 10. The rod 17 engaged in the hole 16 is placed in front of the seat portion 8 to allow the child to sit on the seat portion 8 with the rod 17 between his/her legs as an additional safety element to prevent the child from sliding in front of the booster seat 1.

According to a preferred embodiment, the seat portion 8 comprises a housing 22 for containing the buckle of a safety belt when the latter is not in use. For example, if the booster seat 1 is used as a floor seat, no safety belt will be required. In FIG. 8, the booster seat 1 has the tray 9 disengaged.

According to a preferred embodiment, not shown in the accompanying figures, the safety belts for securing the booster seat 1 to the adult chair can be engaged to the lower base portion 5 to engage the booster chair 1 to the seat portion of the adult chair and to the rear structure 4 to engage the booster seat 1 to the backrest of the adult chair using quick engagement/disengagement means.

Figure 7:
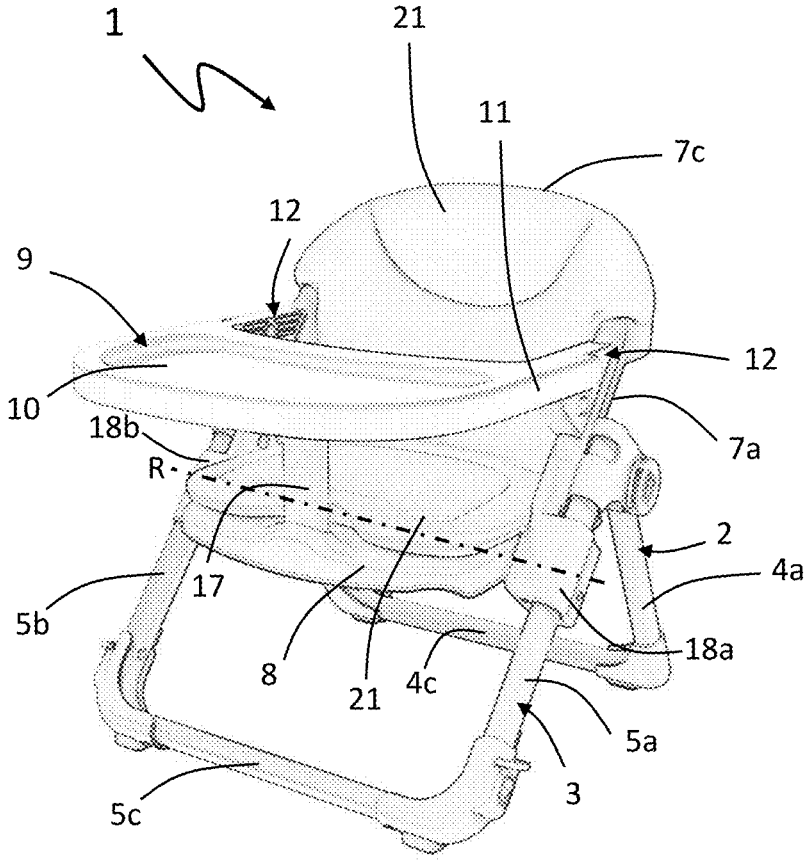
FIG. 7 shows a perspective view of a booster seat of the present invention, with one detail highlighted.

According to a preferred embodiment, as shown in FIG. 7, the booster seat 1 comprises a textile insert 21 on the seat portion 8 and on the upper backrest portion 6. The textile insert 21 may either be a single piece from the seat portion 8 to the upper backrest portion 6 or be composed of two separate pieces, one on the seat portion 8 and the other on the upper backrest portion 6, which are not connected to each other.

In a preferred embodiment, not shown in the accompanying figures, the hole 16 comprises a fastening member for engagement of the free lower end of the rod 17 and a push-button that may be pressed to disengage the rod 17 from the hole 16. Preferably, this push-button comprises a tab that can be manually pressed to disengage the rod 17 from the hole 16. Preferably, the rod 17 comprises a fastening receptacle for the fastening member. The engaging receptacle is in the form of a hole present at the free lower end of the rod 17, i.e. the one that is not attached to the base plate 10.

Two modes of use of the booster seat 1 by a user are described below, with the booster seat 1 being moved from the open configuration to the closed configuration and vice versa respectively.

According to a mode of use of the booster seat 1, in order to move from the open configuration (FIG. 1) to the closed configuration (FIG. 5), the rod 17 is disengaged from the hole 16. Then, the seat portion 8 is commuted from the open configuration to the closed configuration after commuting the locking/unlocking means 13 from the locked configuration to the unlocked configuration (FIG. 3). Subsequently, the tray 9 is moved from the use configuration to the stored configuration (FIG. 4). Now, the backrest portion 6 may be lowered using the sleeve 18*a*, 18*b* for the backrest seat 1 to be even more compact in the closed configuration (FIG. 5). Finally, the rear structure 4 is moved to a position substantially parallel to the tray 9, the seat portion 8 and the lower base portion 5, to fold the booster chair 1 to a completely closed position (FIG. 5).

On the other hand, in another mode of use of the booster seat 1, in order to move from the closed configuration (FIG. 5) to the open configuration (FIG. 1), the rear structure 4 is initially opened by spacing the lower ends of the rear structure 4 apart from the lower ends of the lower base portion 5 (FIG. 4). Then, the seat portion 8 is moved to the open configuration (FIG. 3) and optionally raised with the backrest portion 6. While the seat portion 8 is moved to the open configuration, the locking/unlocking means 13 automatically move to the locked configuration. The tray 9 is moved from the stored configuration to the use configuration by engagement of the rod 17 in the hole 16 for supporting the base plate 10 of the tray 9 with the latter projecting out of the upper backrest portion 6 in cantilever fashion (FIG. 1).

The frame 2 is composed of a lower base portion 5 and a rear structure 4, which are rotatably attached to each other over the seat portion 8. Therefore, considering the structure of the booster seat 1 the latter may be folded or deployed to the closed and open positions in a single step, unlike the prior art in which the booster seats reached the closed or open positions with a minimum of three steps: removing the tray from the frame, folding or deploying the frame, and engaging the tray back with the frame.

Advantageously, the booster seat of the present invention may be folded to the closed position with a simple and smooth mechanism, without requiring the tray to be separated from the rest of the booster seat.

Advantageously, a single booster seat assembly 1 may be obtained, that is compact and easy to carry and store.

A skilled person may obviously envisage a number of changes to the above described variants, without departure from the scope as defined by the appended claims.

The invention claimed is:

1. A booster seat for children, comprising:

a frame composed of a front structure and a rear structure, said front structure being composed of a lower base portion and an upper backrest portion comprising two upper lateral uprights, said rear structure being rotatably attached to the lower base portion;

a seat portion rotatably attached to the upper backrest portion;

a tray comprising a base plate and a pair of lateral arms, which are connected to the base plate;

engagement/disengagement assembly for reversibly attaching the tray to the upper backrest portion of the booster seat, said engagement/disengagement assembly being composed of a pair of first components respectively fixed to the upper lateral uprights and a pair of second components which can be reversibly engaged with the pair of first components respectively;

characterized in that the pair of second components is rotatably attached to the pair of lateral arms of the tray to commute said tray between a use configuration in which the tray overhangs the upper backrest portion and a stored configuration in which the tray is substantially parallel to the upper backrest portion;

the booster seat can be positioned between an open configuration and a closed configuration whereby, in the open configuration, lower ends of the lower base portion and lower ends of the rear structure are spaced apart with the seat portion substantially parallel to the tray which is in the use configuration, in the closed configuration the lower ends of the lower base portion are close to the lower ends of the rear structure with the seat portion and the tray substantially parallel to the upper backrest portion.

2. A booster seat as claimed in claim 1, comprising two sleeves fixed to sides of the upper backrest portion and telescopically connected to the lower base portion, whereby the seat portion is rotatably attached to the sleeves.

3. A booster seat as claimed in claim 2, wherein:

the lower base portion comprises two lower lateral uprights, each upper lateral upright is telescopically connected to a respective lower lateral upright via a respective one of said two sleeves, the two sleeves being fixed to sides of the two upper lateral uprights.

4. A booster seat as claimed in claim 1, comprising:

lock/release means operable on the seat portion to reversibly move between a lock configuration in which the seat portion is constrained in its rotation relative to the upper backrest portion and a release configuration in which the seat portion is released in its rotation relative to the upper backrest portion, wherein the booster seat is positioned between the open configuration and the closed configuration by positioning the lock/release means from the lock configuration to the release configuration, whereby in the open configuration the lock/release means are in the lock configuration, in which they hold the seat portion substantially parallel to the tray, which is in the use configuration.

5. A booster seat as claimed in claim 4, wherein the lock/release means are disposed on an underside of the seat portion.

6. A booster seat as claimed in claim 4, wherein:

the seat portion is rotatably attached to the upper backrest portion about an axis of rotation;

the lock/release means comprise a pair of retaining members and a lever which is operable on the pair of retaining elements, the retaining elements engage the frame in two respective locations behind the axis of rotation of the seat portion to prevent the rotation of the seat portion relative to the upper backrest portion in the lock configuration, the lever is manually operable to disengage the retaining elements from the frame in the release configuration, to move the seat portion from the use configuration to the stored configuration.

7. A booster seat as claimed in claim 1, wherein:

upon positioning between the open configuration and the closed configuration, the seat portion moves from the open configuration to the closed configuration to move the tray from the use configuration to the stored configuration.

8. A booster seat as claimed in claim 1, wherein:

upon positioning between the open configuration and the closed configuration, the rear structure is substantially parallel to the tray, the seat portion and to the upper backrest portion.

9. A booster seat as claimed in claim 1, wherein the seat portion comprises a hole in a substantially central position of the seat portion;

the tray comprises a rod which is rotatably attached to the base plate and is configured to move from a support position in which the rod is perpendicular to the base plate and fits in the hole to hold the tray in the use configuration and a rest position in which said rod is disengaged from the hole and is substantially parallel to the base plate.

10. A booster seat as claimed in claim 1, wherein the booster seat comprises a textile insert on the seat portion and on the upper backrest portion.

* * * * *